United States Patent [19]

Philberth et al.

[11] 4,149,136

[45] Apr. 10, 1979

[54] CORE LAMINATION FOR SHELL-TYPE CORES, PREFERABLY FOR TRANSFORMERS

[76] Inventors: Karl Philberth; Bernhard Philberth, both of Peter-Rosegger-Strasse 6, Puchheim, Fed. Rep. of Germany

[21] Appl. No.: 838,977

[22] Filed: Oct. 5, 1977

[30] Foreign Application Priority Data

Dec. 23, 1976 [DE] Fed. Rep. of Germany ..... 2658665

[51] Int. Cl.[2] ..... H01F 27/24

[52] U.S. Cl. ..... 336/217; 336/234

[58] Field of Search ..... 336/212, 216, 217, 233, 336/234, 178

[56] References Cited

U.S. PATENT DOCUMENTS

| | | | |
|---|---|---|---|
| 1,385,624 | 7/1921 | Kent | 336/212 X |
| 3,270,307 | 8/1966 | Jean et al. | 336/217 |
| 3,546,571 | 12/1970 | Fletcher et al. | 336/178 X |
| 3,631,534 | 12/1971 | Hirota et al. | 336/212 X |

FOREIGN PATENT DOCUMENTS

| | | | |
|---|---|---|---|
| 510758 | 5/1952 | Belgium | 336/217 |
| 794016 | 9/1968 | Canada | 336/217 |
| 1152204 | 8/1963 | Fed. Rep. of Germany | 336/212 |
| 2454419 | 5/1976 | Fed. Rep. of Germany | 336/217 |
| 2541815 | 3/1977 | Fed. Rep. of Germany | 336/217 |
| 67594 | 3/1958 | France | 336/217 |

*Primary Examiner*—Thomas J. Kozma

[57] ABSTRACT

The invention concerns a transformer lamination having a center leg, two outer legs and two yokes connecting these legs and having at least one joint between one side of the center leg and the adjacent yoke. Characteristic features are that the length of the joint at each side of the center axis is at least 0.75 times the center leg width and that the joint has at least one concave part and at least one convex part on at least one side of the center axis. A preferred embodiment contains two symmetrical joints, each of them comprising two sections which are parallel to the center axis and one section which is perpendicular to the center axis.

25 Claims, 7 Drawing Figures

CORE LAMINATION FOR SHELL-TYPE CORES, PREFERABLY FOR TRANSFORMERS

The invention relates to a core lamination for shell-type cores, preferably for transformers, repeaters, chokes and other similar devices, consisting of a plurality of alternately interleaved core laminations, which core lamination has a center leg, two outer legs parallel thereto at a certain distance, and two yokes connecting the ends of said legs, at least one joint being provided between one side of the center leg and the adjacent yoke for interleaving in the winding.

In standard core laminations of this kind the width $c_1$ of the jointlessly connecting yoke is equal to the width $c_2$ of the parted yoke, and the sum of said two widths $c_1$ and $c_2$ is equal to the width f of the center leg. Transformers consisting of such core laminations do not make optimum use of the material, and their joints exhibit undesirably high reluctance.

A catalog which was published by Kienle & Spiess GmbH, Grossachsenheim in 1952, shows a core lamination section in which the joint extends within the yoke such that the center leg continues into the yoke by four-sixths of the yoke width. This does in fact reduce the reluctance of the joints as compared with standard cores, but it is still too high for exacting demands. German document laid open for inspection (DT-OS) No. 2,454,419 refers to similar core lamination sections in which the joints extend within the yoke in such a way that the center leg continues into the yoke by three-sixths to five-sixths of the yoke width.

To suppress the reluctance of the joints, it has been proposed, e.g. in German application print (DT-AS) No. 1,053,096, to use core laminations in which the yoke width amounts to 1.5 times or even 2 times half the width of the center leg and the joints represent a linear continuation of the center leg edges or extend diagonally from the inner window corners to the center of the outer yoke edge. However, yokes of such great width imply higher-than-normal material amounts and weights. Said application print also features a joint which extends within the yoke in such a way that the center leg continues well into the yoke.

Core laminations have also been proposed, which have yokes approximately 1.35 times wider than half the width of the center leg, with joints extending asymmetrically to the center axis. Yoke widths of this nature give excellent utilization of both grain-oriented and isotropic material. Besides, the reluctance of the joints in transformers consisting of such core laminations is extremely low when the core laminations in the stack comprise successive groups of four alternately interleaved layers. However, this interleaving process necessitates more expensive interleaving machinery than for core laminations interleaved conventionally in pairs of alternate layers.

In contrast, the object of the invention is to improve the core lamination of the type named at the beginning in such a way that transformers or other kinds of induction devices that contain said core lamination unite the advantages of a small amount of material, high quality and ease of manufacture.

According to the invention this object is achieved in that the sum of the width of the jointlessly connecting yoke and the width of the parted yoke is at least 1.25 times and max. 1.45 times the center leg width, in that the length of the joint at each side of the center axis is at least 0.75 times the center leg width and in that the joint has at least one concave part and at least one convex part on at least one side of the center axis, relative to said center axis.

At one time it was incorrectly thought that a jointless magnetic circuit of isotropic material was at its optimum when its cross-section was of equal size throughout. However, this opinion has been refuted by the subject of German patent No. 1,223,473 and by special publications made in connection therewith. In fact, a partly wound magnetic circuit reaches its highest performance per unit of material and also very low magnetic leakage and pick-up when its bare limbs are of greater width, i.e. when the yokes and outer legs of a shell-type core are wider than the covered center leg. Theory and practice demonstrate that when the joints are neglected, it is most beneficial — with regard to both the reactive and active losses — to increase the doubled yoke cross-section by approximately the factor 1.25 to 1.45 as compared with the center leg cross-section. The optimum value for isotropic material is closer to the bottom limit whereas the best value for Goss grain-oriented material, which has its preferred direction of orientation parallel to the center leg, is closer to the top limit. With due allowance for the fastening holes, excellent values are roughly the factor 1.3 for isotropic material, and 1.4 for grain-oriented material. The range between these two values and particularly the value of approximately 1.35 are eminently suitable for universal cores of most standard materials. Another advantageous feature in this connection is also obtained when the width of the two outer legs together is roughly 1.2 times to 1.3 times the width of the center leg.

The shell-type core has to be capable of insertion in a finished winding for practical purposes. To this end, the core laminations forming the shell-type core need joints. It was commonly felt in the past that shell-type cores having said optimum yoke size increasing factor of 1.25 to 1.45 have to put up with at least one of two disadvantages, either considerable reluctance due to the joints or increased expenditure on making the core from laminations arranged in groups of four alternately interleaved layers. The present invention achieves the surprising effect that it avoids both these disadvantages.

Each joint in a shell-type core consisting of laminations arranged in pairs of alternately interleaved layers, overlaps once only. It is common knowledge that the ideal situation for singly overlapping joints is achieved when the entire joint is twice as long as the center leg is wide. However, more detailed investigations have demonstrated that the joint need not be so long in, for instance, mains transformers made of isotropic material. The saturation induction of currently common isotropic transformer laminations is roughly the factor $\sqrt{2}$ above the induction at which the magnetization characteristic breaks down by a more or less severe degree. This is to be explained by the fact that the material consists of magnetic elementary regions which have to be magnetized chiefly in the (1,0,0) direction below the breakdown induction, yet also in the (1,1,0) direction above the breakdown induction and finally even in the (1,1,1) direction. In a shell-type core whose center leg is operated on the basis of said breakdown induction, the singly overlapping places thus reach the point of saturation precisely when the joint length is $2/\sqrt{2} = \sqrt{2}$ times, and not 2 times, the center leg width. However, the operating induction of the center leg may be made moderately higher than the breakdown induction in shell-type cores which have yokes and/or outer legs wider than the wound center leg. This leads to the teaching disclosed by the invention, namely that in yokes with optimum increases in yoke size the joint length is to be moderately more than $\sqrt{2} = 1.41$ times the center leg width, namely 1.5 times at least. At a joint length of only 1.5 times the center leg width in conjunction with greater center leg induction, a small proportion of the magnetic flux can actually be passed through the joint itself. This can be accepted for not too exacting demands.

The core laminations of the invention are designed primarily yet not exclusively for shell-type cores in which said core laminations are only ever arranged in pairs of two alternating layers. To keep the reluctance of the joints small on both sides, the invention teaches us not only that the entire joint length is to be at least 1.5 times the center leg width but that the joint length is also to be at least $1.5/2 = 0.75$ times the center leg width on each side of the center axis in particular. As regards shell-type core laminations which have so far been made known and have yokes 1.25 to 1.45 times the width of the center leg width, the joint length is smaller than 0.75 times the center leg width on at least one side of the center axis.

With regard to shell-type core laminations which have yokes equal in width to half the center leg width on both sides, a magnetic advantage is obtained when the path of the joint does not depart too much from the diagonal connecting the accompanying inner window corner to the center of the outer yoke edge. For if the joint of a core of such dimensions extends from the inner window corner by, for instance, a large amount as a linear continuation of the longitudinal center leg edge or perpendicular thereto, the magnetic flux — in the yoke in the first case and center leg in the second — will be forced partly away from the window corner, its density thus being increased locally. This is disadvantageous for grain-oriented material in particular. The invention shows that the situation changes when the yokes on both sides together are of substantially greater width than the center leg.

Joints running along the diagonals connecting the inner window corners to the center of the outer yoke edge have a variety of disadvantages. For example, their length in a yoke that is not excessively wide is inadequate for very exacting demands. Besides, the flux in grain-oriented material must pass through the overlapping zone in the worst direction, namely at 50° to 55° relative to the preferred direction of orientation. In addition, the sharp points at the yoke ends and center leg end are undesirable from the tooling point of view. Moreover, there are no semi- or fully-mechanical devices available for interleaving such laminations in windings.

According to the conception underlying the invention it is important not only that the joints are of adequate length but also that the magnetic flux can reach and leave with little reluctance the overlapped joint that is to be crossed. This is not true of joints curved in one direction only — in the event that such curvature is so great that the joint length is made substantially larger than that of straight joints. The example denoted by the short broken lines in FIG. 1 (these do not represent part of the invention) demonstrates that increases in flux density occur locally in the region of the yokes or center leg, so giving rise to greater reluctance.

In contrast, the joints of the invention serve to minimize the reluctance both of the joints themselves and of the region upstream and downstream thereof in the direction of the flux; this also holds good for singly overlapped joints, that is when the core laminations in the shell-type core are interleaved in just two different layers. Thus, the joints of the invention afford a much greater advantage than might be expected from the resulting elongation of the joint. The joints of the invention would not give a substantial advantage or might not even give any advantage at all if the yoke widths were not made larger, as defined by the invention, than the center leg width. The unification of these elements thus gives an additional and surprising combination effect.

An advantageous configuration of the invention is obtained when the width $c_1$ of the jointlessly connecting yoke is greater than the width $c_2$ of the parted yoke. Hence, less than 50% of the yoke material cross-section consists of parted core lamination yokes in the alternately interleaved core. Some of the magnetic flux emerging from the center leg can swing sideways along a shorter magnetic path into the jointlessly connecting core lamination yokes without travelling past a joint. It may be beneficial under these circumstances when the joint first follows a convex course — relative to the center axis — and then a concave course, starting from the inner corner of the accompanying core lamination window.

It goes without saying that in the core lamination of the invention the width $c_1$ of the jointlessly connecting yoke may also be the same size as the width $c_2$ of the parted yoke. In this case it is very advantageous when a joint part which is concave relative to the center axis is followed by a convex part at a larger distance along the joint from the accompanying core lamination window corner.

It is common practice nowadays, and also expedient in connection with core laminations according to the invention, to make the joint not as a plain parting but in the form of an air gap, for example as a hairline gap 0.05 mm to 0.3 mm wide. This stops the end of the center leg from getting caught by the yoke, for this would be undesirable from the point of view of manufacture. When the joints are designed as air gaps, their minimum length and the suitable course thereof must meet very high requirements because the reluctance of the gap is proportional to its width.

The joints according to the invention may be symmetrical or asymmetrical to the center axis. Asymmetrical joints in conjunction with groups of four alternately interleaved core laminations give three-fold overlapping of the joints in parts at least, which may be advantageous for grain-oriented material and very high demands.

Joints of the invention provide good magnetic characteristics, for grain-oriented material too, when their overall length is at least equal to the length of the two diagonals running from the inner core lamination window corner to the center of the outer yoke edge. Said length is equal to $\sqrt{4c_2^2 + f^2}$ when $c_2$ denotes the width of the parted yoke and f the center leg width. Outstanding magnetic characteristics are obtained from joints according to the invention when their overall length is approximately equal to or even greater than $2f-2(c_1-c_2)$ where $c_1$ is the width of the undivided yoke. In this case the flux density at the points of overlapping is not higher or not much higher than in the center leg, even when the joints overlap once only. Joints which are much longer, for instance larger than 1.1 times or even 1.2 times $2f-2(c_1-c_2)$, normally imply wastage and may even be disadvantageous. However, joints of such great length may be advantageous in cases where core laminations of different thickness and or different quality are used in the various layers of the shell-type core; for example, two oppositely directed core laminations of 0.35 mm thick, grain-oriented material for every core lamination of 0.75 mm thick, cold-rolled material.

The core laminations of the invention may have two joints, each of which reaches the outer yoke edge, or a single joint within the yoke. In the first case, it is advantageous when each joint ends at a point on the outer yoke edge which is further away from the imaginary linear continuation of the longitudinal center leg edge on the same side than from the center axis, yet not reaching as far as the center axis itself. In the second case it is advantageous when the joint is straight in the region of intersection with the center axis, and when it is perpendicular to the center axis.

The invention teaches that the joints are not to coincide along their entire length with the diagonals connecting the accompanying inner core lamination window corner to the center of the outer yoke edge. However, they may coincide partly with said diagonals. It is advantageous when the joints do not move too far away from the accompanying diagonals. For example, a beneficial configuration is obtained when, on at least one side of the center axis, no part of the joint is more than a quarter or much more than a fifth of the center leg width away from the accompanying diagonal line. As regards joints which are situated entirely within the yoke, it may be very advantageous when said distance is no more than one-sixth of the center leg width. It is advantageous to make the joints intersect the diagonal at least twice.

The joints of the invention assume very favourable proportions when they comprise at least one section which is approximately parallel or approximately perpendicular to the center axis. Such sections help greatly to extend the joint and serve to promote magnetic flux in grain-oriented material. Sections of this kind may be joined, for instance, by sharp corners, by curves or short slanting portions. The more such successive sections there are, the closer the joint can get to said diagonal, e.g. in steps or meandering lines. However, too many sections of this kind do not afford any more advantages and may even give magnetic disadvantages in addition to manufacturing difficulties. For at the points where the joints overlap the magnetic flux has to diverge on both sides of the joint to the undivided lamination layers in a length of the order of 1 mm. This leads to local flux distrubances at each right-angled corner or each sharp bend of the joint, so adding up to a considerable overall effect.

Very beneficial joints are those which contain, on at least one side of the center axis, one or two sections approximately parallel to the center axis and/or one or two sections approximately perpendicular to the center axis. A magnetic advantage is obtained, especially in core laminations with yokes of equal width on both sides ($c_1 = c_2$), when on at least one side of the center axis the joint forms, in the first fifth of its path from the accompanying window corner, an average angle of not much more than 45° with the outer center leg edge; said angle is preferably between 0° and 30°.

Several embodiments of the invention are represented diagrammatically in the drawings, in which.

Figure 5:
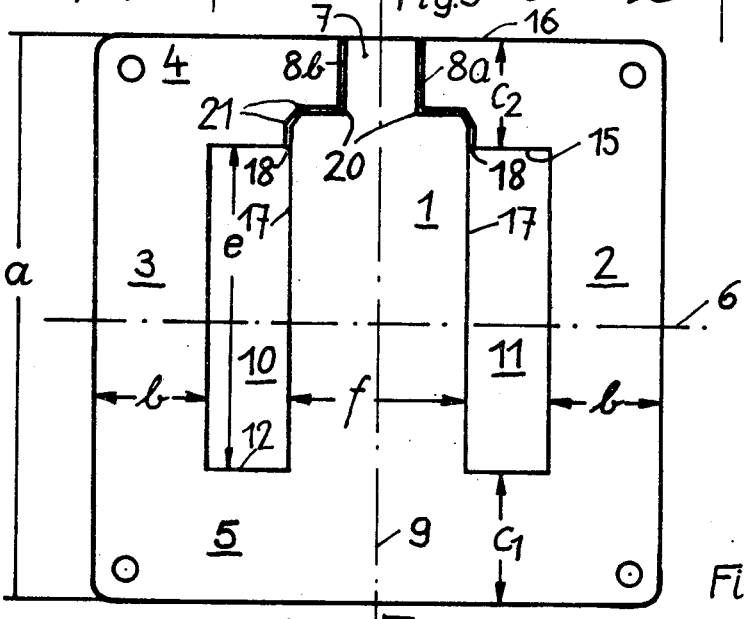

FIG. 5 is the plan view of a core lamination featuring two joints which are symmetrical to, and do not intersect, the center axis. The joints are designed in the form of hair-line gaps of a width which is exaggerated here for the sake of clarity. The width of the jointlessly connecting yoke is greater than that of the parted yoke.

Figure 6:
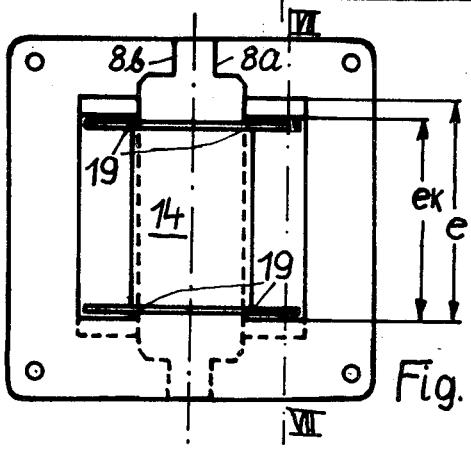

FIG. 6 is the plan view of a shell-type core which consists of interleaved core laminations according to FIG. 5 and has a bare coil form.

Figure 7:
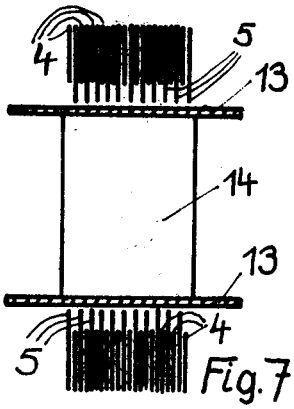

FIG. 7 is a section of the shell-type core and coil form according to FIG. 6.

Further examples of core laminations according to the invention are obtained from FIG. 1 to 5, any side shown to the right of the center axis 9 being complemented by the side shown to the left of the center axis 9 in any other of these five diagrams.

The core lamination according to FIG. 5 is a preferred embodiment of the invention. It is of square design and consists of a center leg 1, two outer legs 2 and 3 parallel thereto at a certain distance, and two yokes 4 and 5 connecting the ends of said legs, two joints **8*a* and 8*b* being provided between one end 7 of the center leg 1 and the adjacent yoke 4 to permit insertion in the winding not shown in FIG. 5. The sum of the width $c_2$ of the parted yoke 4 and of the width $c_1$ of the jointlessly connecting yoke 4 is larger than the width f of the center leg 1. Similarly, the sum of the widths b of the two outer legs 2 and 3 is greater than the width f of the center leg. The center leg 1, the outer legs 2 and 3 and the yokes 4 and 5 enclose the windows 10 and 11, being of length e calculated in the direction of the center axis 9. Since the width $c_1$ of the jointlessly connecting yoke 5 is larger than the width $c_2$ of the parted yoke 4 in this embodiment of the invention, the windows 10 and 11 are asymmetrical to the transverse axis 6. The outer edge parallel to the center leg 1** is of length a.

The shell-type core according to FIG. 6 contains core laminations according to FIG. 5, which are interleaved alternately in two different layers. When both these opposing layers of equal numbers of core laminations are assumed to be of identical thickness, both yokes of the shell-type core have the same cross-section and this cross-section bears the relationship $\frac{1}{2}(c_1 + c_2)/f$ to the cross-section of the center leg of the shell-type core. The iner edges 12 of the jointlessly connecting yokes 5 of the core laminations are practically touching the flanges 13 of the coil form 14 bearing the winding not shown here. In contrast, the inner edges 15 of the parted yokes 4 of the core laminations are spaced away from the flanges 13 of the coil form 14 by an amount larger by the difference between the core lamination yoke widths ($c_1-c_2$). The inside length $e_K$ of the shell-type core window is shorter by the difference $c_1-c_2$ between the core lamination yoke widths than the length e of the windows 10 and 11 of each individual core lamination.

FIGS. 1 to 4 only show the parted yoke 4 of the width $c_2$ of core laminations according to the invention. Said width $c_2$ is greater than half the center leg width f. The width $c_1$ of the yoke not shown here may be equal to, or different from, $c_2$; it is advantageous to be greater than $c_2$. Very beneficial and realistic relations are obtained, for instance, when $c_1/f = 0.72$ and $c_2/f = 0.62$, hence $(c_1+c_2)/f = 1.34$, as is approximately true of the core lamination according to FIG. 5.

Figure 1:
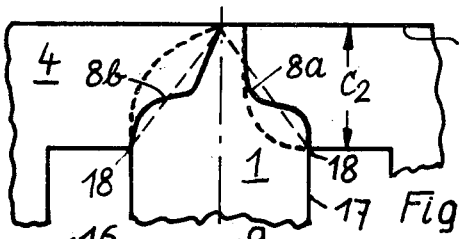
FIG. 1 is the partial plan view of a core lamination featuring asymmetrical joints. The center axis is denoted by a dash-dot line, the diagonals connecting the inner window corners to the center of the outer yoke edge are marked by long broken lines; examples of joints not representing part of the invention are indicated by short broken lines.

Neither of the two joints denoted by short broken lines in FIG. 1 has both concave and convex portions, relative to the center axis 9. Hence, such joints do not form part of the invention. Although both these joints are longer than the diagonals denoted by long broken lines, they still do not represent a good solution. The left-hand one forms a very acute angle with the outer yoke edge 16, so being poor both magnetically and for the purposes of manufacture. The right-hand one is especially poor when the two yoke widths $c_1$ and $c_2$ are equal to one another, because some of the magnetic flux travelling close to the longitudinal center leg edge 17 is forced away by the joint toward the center axis at a slanting angle.

Figure 3:
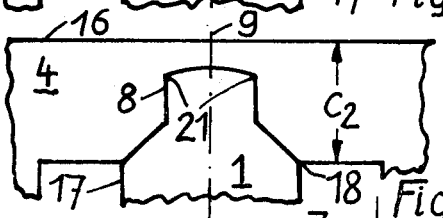
FIG. 3 is the partial plan view of a core lamination with a joint which extends within the yoke, is symmetrical to the center axis, and strts at the window corners at a slanting angle to the longitudinal center leg edge.
Figure 4:
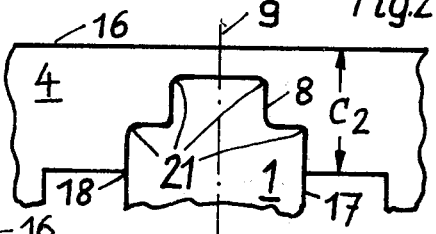
FIG. 4 is the partial plan view of a core lamination with a joint which extends within the yoke, is symmetrical to the center axis, and extends a little way from the window corners as a linear continuation of the longitudinal center leg edge.

These disadvantages are avoided by the joints **8*a* and 8*b* according to the invention; these joints are denoted by solid lines in FIG. 1. Always viewing relative to the center axis 9, both joints 8*a* and 8*b* proceed from the accompanying window center 18, first following a concave and then a convex course. In the core lamination shown in FIG. 2 the right-hand joint 8*a* first has a convex portion, then a concave section and a convex portion again. In FIG. 3, the convex portion of the joint 8 precedes the concave part on both sides of the center axis 9. In FIG. 4, the joint 8 has a convex portion between two concave parts on both sides of the center axis 9. In FIG. 5 the convex portion of each joint 8*a* and 8*b* follows a two-part concave portion. The concave and convex portions of the joints 8, 8*a* and 8*b*** may be designed as corners, arcs or other kinds of curves.

In the core laminations according to FIGS. 1, 4 and 5, the joints 8, **8*a* and 8*b* according to the invention start at the accompanying window corner 18, representing a linear continuation of the longitudinal center leg edge 17 and maintaining this direction exactly or roughly for a certain distance. this is very beneficial, especially for grain-oriented material, because the magnetic flux coming from the coil wound part of the center leg 1 can thus continue in the region of each inner window corner 18 without being disturbed much, partly retaining its direction and partly crossing at right-angles the overlapped joints 8, 8*a* and 8*b***.

In the joints 8, **8*a* and 8*b* according to FIG. 4 and FIG. 5 the concave part is followed by a portion which is perpendicular to the center axis 9 and is roughly one quarter as long as the center leg width f. This affords, among other things, the advantages that the joints 8, 8*a* and 8*b* are long, that they intersect the imaginary diagonal (FIG. 1**) and that they provide in the overlapping lamination layers the ideal crossing direction for grain-oriented material.

In the joints 8, **8*a* and 8*b* according to FIG. 4 and 5, said portion is followed firstly by a convex corner and secondly by a section which is parallel to the center axis 9 and continues in FIG. 5 to the outer yoke edge 16 by a length amounting to roughly two-fifths of the center leg width f. The joints 8, 8*a* and 8*b* are thus made long and again intersect the imaginary diagonal. In the joint according to FIG. 4 there is one more portion consisting of a very shallow arc. This helps hold the yoke 4** together mechanically.

Figure 2:
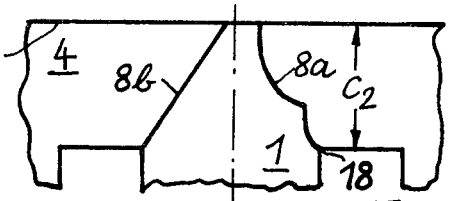
FIG. 2 is the partial plan view of a core lamination featuring two joints which are asymmetrical to, and do not intersect, the center axis.

The right-hand joint **8*a* according to FIG. 2 and the joint 8 according to FIG. 3, proceeding again from the accompanying window corner 18, have a convex portion before the concave section. The convex portion of the joint 8*a* in FIG. 2 is so shallow that it constitutes but little or no magnetic disadvantage, yet facilitates the operation of interleaving the core laminations in the winding. The joint in FIG. 3, that forms at the accompanying window corner 18 an angle of about 45° relative to the center axis 9, is of a more serious nature. However, this slanting angle which is beneficial for interleaving the core laminations is of no disadvantage magnetically when the yoke width $c_1$ is greater than the yoke width $c_2$. A slight slant to facilitate the interleaving of the laminations is also provided in the joints 8*a* and 8*b* according to FIG. 5**.

In the core lamination according to FIG. 5 the joint corner 20, which is convex relative to the center axis 9, is designed in such a way that the distance at which it is set from the prolongation of the accompanying longitudinal center leg edge 17 is approximately half as large as the sum formed by the joint lengths between said corner 20 and accompanying inner core lamination window corner 18, and by the yoke width difference $c_1-c_2$. This sum is equal to the distance between the corner 20 of each joint **8*a* and 8*b* and the accompanying clear inner window corner 19 of the shell-type core, which distance is reckoned along the joint 8*a* and 8*b* and the subsequent portion of the longitudinal center leg edge 17. This means that in a shell-type core consisting of laminations interleaved in two different, opposing layers, the center leg 9** will not show any local flux density rises even when no flux at all crosses the actual gap.

In the joints 8, **8*a* and 8*b* according to FIGS. 3, 4 and 5 the distances of the concave corners 21 of the joints 8, 8*a* and 8*b* from the center axis 9 and outer yoke edge 16 are designed in such a way that between said corners 21 and the outer yoke edge 16 the flux density is reduced appropriately relative to the center leg 9 as a result of the joint lengths left between said corners 21 and the outer yoke edge 16 and center axis 9. The ideal flux density reduction factor $f/(c_1+c_2)$ is not quite reached here. However, the actual reduction factor of about 0.75 to 0.8 is even adequate for very exacting demands. This is achieved in each of the two joints 8*a* and 8*b* according to FIG. 5 in that the distance between the outer yoke edge 16 and the concave corner 21 situated further away from the window corner 18 amounts to approximately 0.6 to 0.65 times the lengths of both joint portions left between said concave corner 21 and outer yoke edge 16. This relation applies analogously to that portion of the joint 8 in FIG. 3 and 4 that is to the right or left of the center axis 9. However, the joint lengths are then to be calculated to the center axis 9 and not to the outer yoke edge 16**.

I claim:

1. Core laminations for shell-type cores, comprising said laminations alternately interleaved, each of said core laminations being of one-piece construction and having a center leg, two outer legs parallel thereto at a certain distance, and two yokes connecting the ends of said legs, at least one joint being provided between one side of the center leg and the adjacent yoke being called a parted yoke for interleaving with a winding and the other yoke having no joints with the center leg and the two outer legs, wherein the sum of the width ($c_1$) of the jointlessly connecting yoke and the width ($c_2$) of the parted yoke is at least 1.25 times and maximum 1.45 times the center leg width (f), wherein the length of the joint at each side of the center axis is at least 0.75 times the center leg width (f) and wherein the joint has at least one concave part and at least one convex part on at least one side of the center axis, relative to said center axis, said alternate interleaving being realized by the joints of the parted yokes being overlapped by the jointlessly connecting yokes of the adjacent laminations.

2. Core laminations as defined in claim 1, wherein the width of the jointlessly connecting yoke is greater than that of the parted yoke ($c_1 > c_2$).

3. Core laminations as defined in claim 1, wherein the width of the jointlessly connecting yoke is equal to that of the parted yoke ($c_1 = c_2$).

4. Core laminations as defined in claim 1, wherein a joint part which is concave relative to the center axis is followed by a convex joint part at a larger distance along the joint from the accompanying window corner.

5. Core laminations as defined in claim 1, wherein the sum of the width ($c_1$) of the jointlessly connecting yoke and of the width ($c_2$) of the parted yoke is at least 1.3 times and maximum 1.4 times the center leg width (f).

6. Core laminations as defined in claim 1, wherein the sum of the width ($c_1$) of the jointlessly connecting yoke and of the width ($c_2$) of the parted yoke is approximately 1.35 times the center leg width (f) and wherein the sum of the two outer leg widths (b) is approximately 1.25 times the center leg width (f).

7. Core laminations as defined in claim 1, wherein each joint is designed as a hairline gap.

8. Core laminations as defined in claim 1, wherein the total joint length is equal at least to the length of both diagonals running from the inner core lamination window corner to the center of the outer yoke edge.

9. Core laminations as defined in claim 1, wherein the total joint length is approximately equal to twice the center leg width (f), minus twice the difference ($c_1 - c_2$) between the width of the jointlessly connecting yoke and the width of the parted yoke.

10. Core laminations as defined in claim 1, wherein the joints are asymmetrical relative to the center axis.

11. Core laminations as defined in claim 1, wherein the joints are symmetrical relative to the center axis.

12. Core laminations as defined in claim 1, wherein on at least one side of the center axis no part of the joint is much more than one fifth of the center leg width (f) away from the diagonal connecting the accompanying core lamination window corner to the center of the outer yoke edge.

13. Core laminations as defined in claim 1, wherein on at least one side of the center axis the joint intersects at least twice the diagonal connecting the accompanying core lamination window corner to the center of the outer yoke edge.

14. Core laminations as defined in claim 1, wherein on at least one side of the center axis the joint extends a little as a linear continuation of the longitudinal center leg edge.

15. Core laminations as defined in claim 1, wherein on at least one side of the center axis the joint contains two sections approximately parallel to the center axis.

16. Core laminations as defined in claim 1, wherein on at least one side of the center axis the joint contains a section which does not intersect the center axis and is approximately perpendicular to said center axis.

17. Core laminations as defined in claim 1, wherein on at least one side of the center axis the joint is shaped substantially like a staircase with a least one and a maximum of two steps.

18. Core laminations as defined in claim 1, wherein provision is made for two joints not intersecting the center axis, each of which joints ends at a point on the outer yoke edge which is situated further away from the imaginary linear continuation of the longitudinal center leg edge on the same side than from the center axis.

19. Core laminations as defined in claim 1, wherein provision is made for a joint not reaching the outer yoke edge, which joint starts at the window corners at a slanting angle to the longitudinal center leg edge.

20. Core laminations as defined in claim 1, wherein on at least one side of the center axis the middle of the joint part that is convex relative to the center axis is located in such a way that the distance at which it is situated from the linear prolongation of the accompanying longitudinal center leg edge is approximately half as large as the sum formed by the joint length between said middle and the accompanying inner core lamination window corner and by the yoke width difference ($c_1 - c_2$).

21. Core laminations as defined in claim 1, wherein on at least one side of the center axis the middle of each concave part is located in such a way that its distance from the outer yoke edge is approximately 0.55 to 0.65 times as large as the joint length between said middle and the outer yoke edge or center axis.

22. Core laminations as defined in claim 2, wherein the sum of the width ($c_1$) of the jointlessly connecting yoke and of the width ($c_2$) of the parted yoke is at least 1.3 times and maximum 1.4 times the center leg width (f).

23. Core laminations as defined in claim 2, wherein the sum of the width ($c_1$) of the jointlessly connecting yoke and of the width ($c_2$) of the parted yoke is approximately 1.35 times the center leg width (f) and wherein the sum of the two outer leg widths (b) is approximately 1.25 times the center leg width (f).

24. Core laminations as defined in claim 2, wherein each joint is designed as a hairline gap.

25. Core laminations as defined in claim 6, wherein each joint is designed as a hairline gap.

* * * * *